United States Patent [19]

Beehler

[11] 3,979,869

[45] Sept. 14, 1976

[54] INSULATED DOOR CONSTRUCTION AND METHOD OF REPAIRING THE DOOR

[75] Inventor: Ernest W. Beehler, Yakima, Wash.

[73] Assignee: Reese & Sons Insulation, Inc., Yakima, Wash.

[22] Filed: June 30, 1975

[21] Appl. No.: 591,442

[52] U.S. Cl. ..... 52/514; 52/586; 52/623; 52/627; 29/401 R

[51] Int. Cl.[2] ..... E02D 37/00

[58] Field of Search ..... 52/623, 627, 586, 624, 52/621, 514, 753 J, 753 K; 29/401 R, 401 D, 401 F

[56] References Cited

UNITED STATES PATENTS

| | | | |
|---|---|---|---|
| 3,230,681 | 1/1966 | Allen et al. | 52/586 X |
| 3,364,645 | 1/1968 | Weuzelberger | 52/627 X |

FOREIGN PATENTS OR APPLICATIONS

| | | | |
|---|---|---|---|
| 173,261 | 11/1960 | Sweden | 52/624 |

*Primary Examiner*—Ernest R. Purser
*Assistant Examiner*—Carl D. Friedman
*Attorney, Agent, or Firm*—Seed, Berry, Vernon & Baynham

[57] ABSTRACT

An insulated door is made of removable modular panels integrally attached together through a continuous border frame and end covering. The panels are also joined together by a wooden spline inserted into the confronting ends of adjacent panels.

A method of repairing an insulated door made of modular panels having a wooden border frame and an end covering joining the panels as well as wooden splines joining the confronting ends of two adjacent panels, comprising cutting the wooden joinder splines, end coverings and border frames, removing the damaged panel, removing the wooden spline from the remaining adjacent panel, cutting back the border frame for a first distance along opposite edges of the remaining panel, cutting back the end covering a greater distance on the opposite edges of the remaining panel, splicing a new panel to the remaining adjacent panel by inserting a new spline, restoring the integrity of the border frame and end covering by providing an extension of the border frame and end covering on the new panel to correspond to the lengths removed from the adjacent remaining panel, and bonding and mechanically fastening the new panel to the remaining adjacent panel.

10 Claims, 11 Drawing Figures

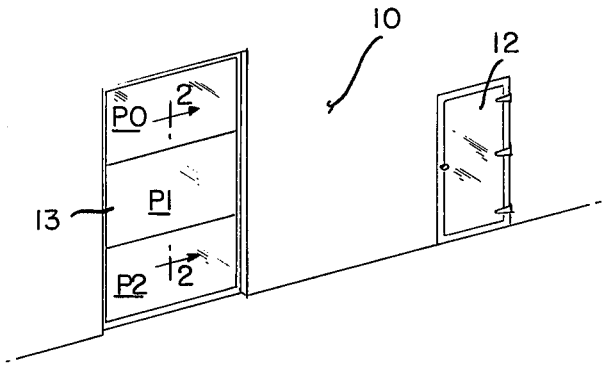
FIG. 1
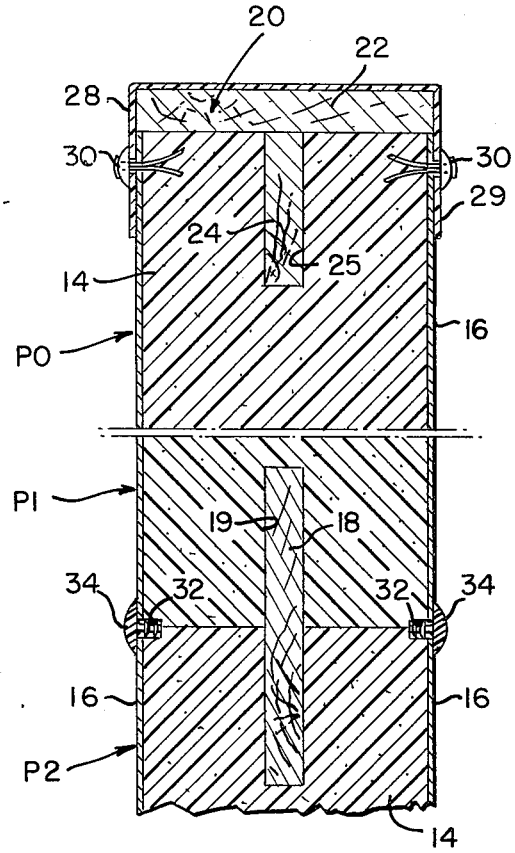
FIG. 2
FIG. 3
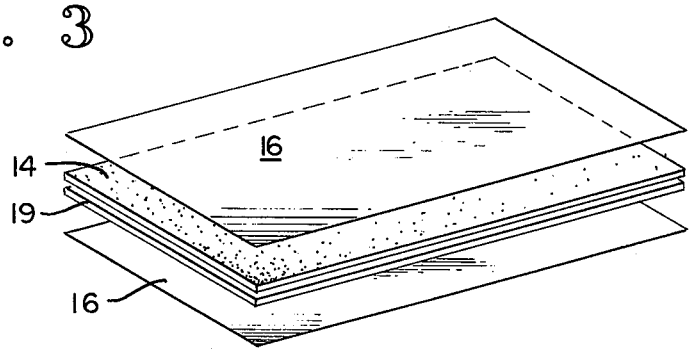
FIG. 4
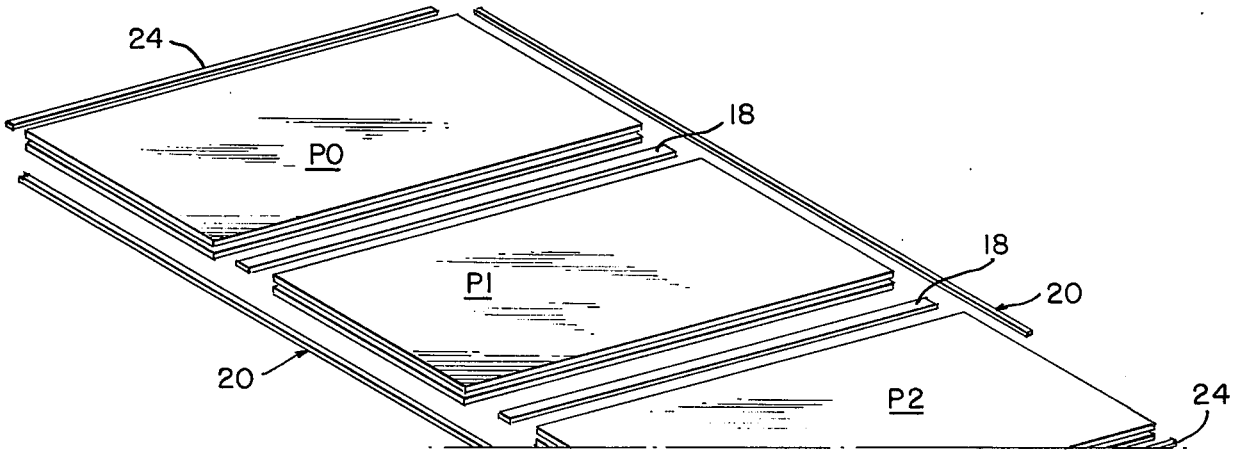

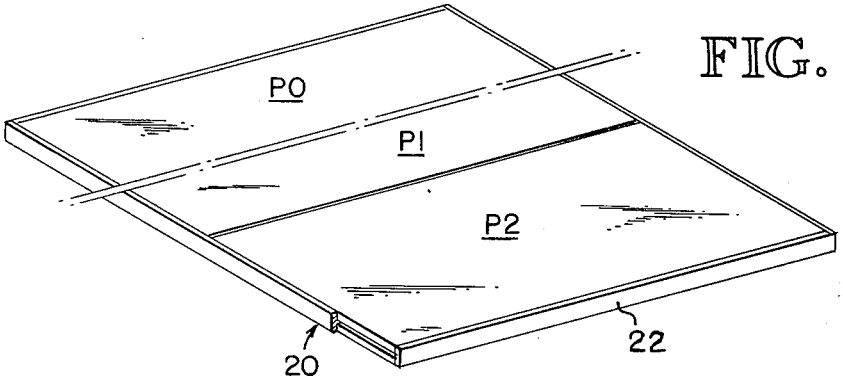
FIG. 5
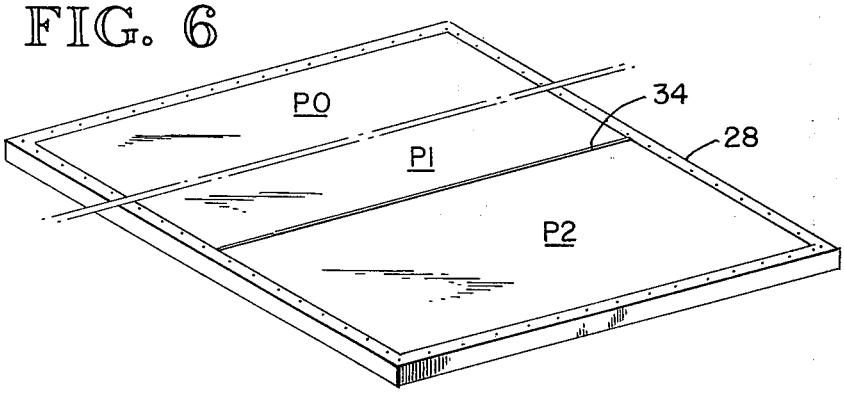
FIG. 6
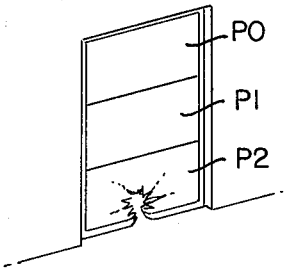
FIG. 7A
FIG. 7B
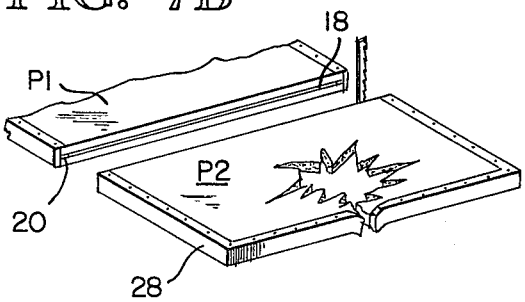
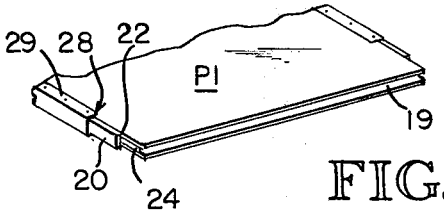
FIG. 7C
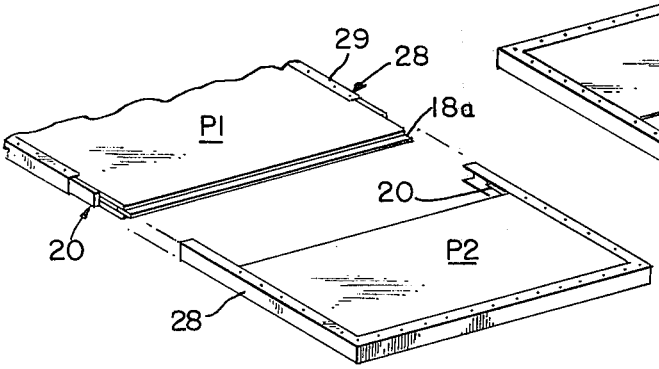
FIG. 7D
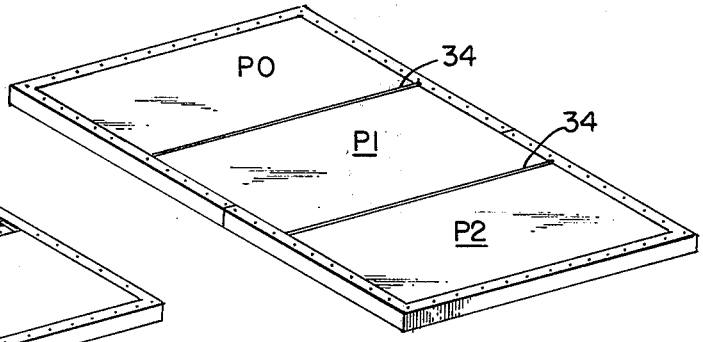
FIG. 7E

INSULATED DOOR CONSTRUCTION AND METHOD OF REPAIRING THE DOOR

BACKGROUND OF THE INVENTION

1. Field of the Invention

This invention pertains to insulated doors of the type used in refrigerated or controlled environment storage warehouses.

2. Description of the Prior Art

Warehouses for storing perishable commodities, such as apples, have long had the need for insulated doors to seal the interior of the warehouse from outside temperature, atmosphere or both. Some of these doors must be large enough to accommodate large forklift trucks carrying the commodity into or out of the warehouse.

The operator's visibility is poor with a loaded forklift truck. Furthermore, some of the large doors are automatically operated to open and close in the minimum amount of time to minimize the loss of the controlled temperature or gaseous environment within the warehouse. As a result, doors are frequently being hit by the loaded forklift carrier due to various circumstances, such as a door closing after the passage of a first loaded forklift into the path of an oncoming second loaded forklift.

Although the damage to the door generally occurs at the lower end of the door, heretofore the damage has required replacement of the entire door to maintain the tight insulating and atmosphere-sealing capability of the door critical to operation of the warehouse. Prior art doors are most commonly made of plywood and weigh approximately five to seven pounds per square foot; thus a ten foot by twelve foot door will frequently weigh as much as 720 pounds and require mechanized equipment plus a crew of at least three men to replace the door. This, of course, is expensive and requires long periods of delay in replacing the door due to the lack of the equipment or available workmen for replacement.

SUMMARY OF THE INVENTION

It is an object of this invention to provide a lightweight insulated door that can be handled by two workmen without special equipment.

It is another object of this invention to provide a method of replacing parts of a damaged door rather than the whole door.

It is another object of this invention to provide a door made of modular panels which will allow replacement of a damaged portion of the door rather than the entire door.

Basically, these objects are obtained by providing an integral door formed of a plurality of modular panels. Each of the panels is provided with a rigid foam core, such as polystyrene foam, covered by damage and weather-resistant face sheets, such as aluminum, and joined in a structurally integral manner with structural wood splines, border frames and end coverings which make the door structurally rigid.

Preferably, the method of replacing damaged modular panels comprises cutting the joinder spline between two adjacent panels, the integral border frame and the end covering to free the damaged panel from the remaining adjacent panel, removing the spline from the remaining adjacent panel, cutting back the border frames and end coverings along a portion of the length of the ends of the remaining adjacent panel, replacing the damaged panel with a new panel having a new spline which extends into the spline-receiving groove of the remaining adjacent panel and with end cover and border frame extensions which correspond to the lengths removed of the remaining adjacent panel, and finally, fastening the new panel to the remaining adjacent panel to restore the structural integrity of the end covering, border frame, and spline connection, thus providing a repaired door with substantially the same strength, insulative, and sealing capability of the original door. The weight of the modular panels is approximately three pounds per square foot, or less than half the weight of conventional plywood doors. A typical ten foot by twelve foot door using the principles of this invention weighs about 360 pounds versus the 720 pounds for prior art doors. This lightweight construction allows the replacement to be done relatively easily by two workmen without special tools. Obviously, the capability of replacing only the damaged panel rather than the entire door also provides a substantial cost savings to the warehouse operator.

BRIEF DESCRIPTION OF THE FIGURES OF THE DRAWING

FIG. 1 is a fragmentary illustration of two representative type doors manufactured according to the principles of the invention.

FIG. 2 is a fragmentary vertical section taken along the line 2—2 of FIG. 1.

FIG. 3 is an exploded view of a portion of a modular panel embodying the principles of the invention.

FIG. 4 is an exploded view of a portion of a door made from modular panels embodying the principles of the invention.

FIG. 5 is an isometric of the door shown in FIG. 4 in a further state of construction.

FIG. 6 shows the door shown in FIG. 4 in its final stage of construction.

FIG. 7A illustrates a representative type of damage to a door.

FIG. 7B shows a first step in replacing the panel of the damaged door shown in FIG. 7A.

FIG. 7C illustrates a second step in the replacement technique.

FIG. 7D illustrates a third step in which the new panel is about to be inserted onto the adjacent remaining panel.

FIG. 7E is a final configuration of a completely repaired door.

DETAILED DESCRIPTION OF THE PREFERRED EMBODIMENTS

As best shown in FIG. 1, a storage warehouse 10 of the type having a controlled environment, such as an inert gas or a refrigerated interior, is provided with one or more doors embodying the principles of the invention. Door 12 is a standard walk-through door, whereas door 13 is larger and is made of one or more panels. This type of door can be a swinging door, slidable door or overhead door, a typical size being ten foot by twelve foot, and suitable for allowing free movement of forklift or other motorized container-moving vehicles. The doors are provided with suitable hanging attachments, rollers, etc. of any conventional type and with suitable seals for providing an airtight fit between the surface of the door and the surrounding door frames.

The door 12 may be made from a single modular panel of the same type as used collectively to form the door 13. FIGS. 2–6 illustrate a typical preferred embodiment of such a panel.

Each panel designated as P0–P2 includes a core 14 of polystyrene foam of sufficient rigidity and density as to provide good structural characteristics and insulative value. A suitable density for styrofoam is 1.8 lbs. per cubic foot. The panel P1 is bounded on either side by aluminum face sheets 16 bonded to the surface of the core. A second panel P2 of substantially identical construction is joined to the first panel P1 by a plywood spline 18 approximately three-fourths of an inch thick and 4 inches in length, extending 2 inches into each panel and resting in a groove 19 cut into the core. Preferably, plywood is used for the spline rather than cut natural wood to reduce cost and gain structural strength. The splines are bonded into the grooves by any suitable adhesive.

The cores 14 and 16 are bounded by a continuous T-shaped border frame 20 formed of a piece of plywood 22 lying across an end of the core and a 2-inch piece of plywood 24 bonded to the piece 22 and bonded in a 2-inch groove 25 in the end of the core. A similar T-shaped border frame formed of pieces 22 and 24 encircles the free ends of each panel in a similar manner.

To add further structural integrity to the combined panels, the T-shaped border frame 20 is further surrounded by an aluminum or plastic end cover 28 having flanges 29 that extend a substantial distance inwardly of the member 22 overlying the face sheets 16. The end cover is bonded to the border frame and the face sheets. A plurality of winged fasteners 30 are driven through the flanges 29, the face sheets 16 and embedded into the foam core 14 with the legs of the fasteners spreading within the polystyrene foam in a conventional manner. As is readily apparent, the combined panels are all rigidly tied together by the splines, border frame and end cover, providing a unitary, high-strength door.

The core and border frame members 20 are readily available on the market. A suitable core unit with facing sheets is manufactured by the Dow Chemical Co., Cape Girardeau, Missouri under the trademark DERASPAN.

To finally finish a panel for insulative and sealing integrity, the joint between the two connected cores is provided with a groove 32 in which is seated a vinyl batten 34. Caulking is provided within the groove also to improve sealing.

FIG. 4 shows two cores of a three-panel door in an exploded position, illustrating the location of the splines 18 and the T-shaped border frames 20. A completed door is shown in FIG. 7E.

The unique method for replacing a damaged panel is best illustrated in FIGS. 7A–7E. FIG. 7A shows the typical type of damaged door. The damage generally occurs in the lower panel P2. After the door is removed, the panel P2 is separated from the panel P1 by sawing through the end cover 28, the border frame 20 and the spline 18. Next, the remaining portion of the spline 18 fastened in the remaining adjacent panel P1 is routed out, leaving the groove 19 in the core. The end member 22 of the border frame 20 on each side of the panel P1 is then cut back a few inches, as shown in FIG. 7C. The member 24 may be routed out and later replaced, but enough structural integrity remains after the repair that generally the member 24 is left in its original condition in the panel P1. The end covering 28 is cut back still further, as shown in FIG. 7C. Next, a new spline 18*a* is inserted and bonded into the groove 19, as shown in FIG. 7D. Next, a new panel P2 having a border frame 20 which extends outwardly from the core the distance cut from the border frame 20 in the adjacent panel P1, and an end cover 28 having an extension equal to the length of the end cover removed from adjacent panel P1, are slid onto the panel P1 until the end covers and the border frames abut one another and the spline 18*a* fits tightly in the groove 19 in the new panel P2. The spline 18*a* is bonded into the new panel and the fasteners 30 are added to the extension of the end cover, leaving a completely repaired door shown in 7E. Finally, the batten 34 is replaced to seal the joint between the panel P1 and P2.

The replacement is considerably less expensive than replacing the total door and can be done very quickly with two men using simple tools.

While the preferred embodiments of the invention have been illustrated and described, it should be understood that variations will be apparent to one skilled in the art without departing from the principles expressed herein. Accordingly, the invention is not to be limited to the embodiment illustrated.

The embodiments of the invention in which a particular property or privilege is claimed are defined as follows:

1. A method of replacing modular door panels, each having an insulating rigid foam core, face sheets on opposite sides of the core, structural wood border frames bounded by an end covering, and wood splines joining abutting panels, comprising:
   - cutting the end coverings, structural wood border frames and spline joinder holding the damaged panel to the adjacent panel,
   - removing the damaged panel,
   - removing the severed half of the spline from the remaining adjacent panel,
   - inserting a new spline in the remaining adjacent panel and joining the new panel and spline to the remaining adjacent panel, and
   - restoring the structural integrity of the border frame and end covering to form a completed door.

2. The method of claim 1, including attaching a gap closure batten between the confronting ends of the remaining adjacent panel and the new panel.

3. The method of claim 1, said step of restoring the structural integrity of the border frame and end covering including removing a portion of the length of the adjacent end of the border frame of the remaining adjacent panel, removing a longer portion of the adjacent end covering of the remaining adjacent panel, adding to the new panel an integral end covering and an integral border frame extending from the new panel respective lengths corresponding to the removed lengths of the end covering and border frame of the adjacent panel, and securely fastening the extended length of end covering and border frame to the remaining adjacent panel.

4. The method of claim 3, said step of securely fastening the extended lengths of end covering and border frame to the remaining adjacent panel including bonding abutting surfaces.

5. The method of claim 4, the end covering having opposite flanges overlying the face sheets of the panels, said step of securely fastening the extended lengths of end covering and border frame to the remaining adjacent panel including driving mechanical fasteners through the end covering flanges, through the side face sheets and into the foam core.

6. The method of claim 3, the end covering having opposite flanges overlying the face sheets of the panels, said step of securely fastening the extended lengths of end covering and border frame to the remaining adjacent panel including driving mechanical fasteners through the end covering flanges, through the side face sheets and into the foam core.

7. A lightweight, modular panel, insulated door comprising:

a plurality of modular panels, each having a rigid insulation foam core, a wooden structural border frame extending along free ends of each panel and protruding into the ends of the panel, face sheets on opposite sides of the foam core, end coverings covering the border frame and having opposite side flanges overlying each face sheet to a depth adequate to overlie the foam core, means for fastening the border frame, face sheets and end covering to the foam core, said fastening means including mechanical fasteners abutting against the outside surface of the flanges of the end coverings and extending through the face sheets and a substantial distance into the foam core, said fasteners being located at closely spaced intervals around the door, and means for joining adjacent panels to form a rigid integral door.

8. The door of claim 7, said means for joining adjacent panels including a spline bonded to the confronting cores of adjacent panels.

9. The door of claim 8, said means for joining adjacent panels including extending the border frames and end covering of aligned panel ends to cover the entire door so that ends of the panels are joined by a continuous border frame and end covering.

10. The door of claim 7, said means for joining adjacent panels including extending the border frames and end covering of aligned panel ends to cover the entire door so that ends of the panels are joined by a continuous border frame and end covering.

* * * * *